US006079067A

United States Patent [19]

Becker et al.

[11] Patent Number: 6,079,067

[45] Date of Patent: Jun. 27, 2000

[54] MULTILAYER INFANT SUPPORT AND RECLINING PILLOW DEVICE

[76] Inventors: Sheryl D. Becker; Paul G. Becker, both of 6845 Bonnie Ave., St. Louis, Mo. 63123

[21] Appl. No.: 09/141,461

[22] Filed: Aug. 27, 1998

Related U.S. Application Data

[60] Provisional application No. 60/057,451, Sep. 3, 1997.

[51] Int. Cl.[7] ..... A47D 13/08

[52] U.S. Cl. ..... 5/655; 5/652; 5/922

[58] Field of Search ..... 5/652, 653, 655, 5/655.9, 632, 922; 297/174, 216.11, 411.24, 488, DIG. 6

[56] References Cited

U.S. PATENT DOCUMENTS

| | | | |
|---|---|---|---|
| 1,386,652 | 8/1921 | Patton | 5/640 |
| 2,046,645 | 7/1936 | Mason | 5/695 |
| 3,606,461 | 9/1971 | Moriyama | 5/652 X |
| 4,441,221 | 4/1984 | Enste et al. | 5/655 X |
| 4,566,449 | 1/1986 | Smith | 5/655 X |
| 4,819,287 | 4/1989 | Halverson | 5/632 X |
| 4,840,362 | 6/1989 | Bremer et al. | 5/922 X |
| 4,907,603 | 3/1990 | Nakaji | 5/922 X |
| 4,951,334 | 8/1990 | Maier | 5/653 |
| 5,257,429 | 11/1993 | Genis | 5/922 X |
| 5,261,133 | 11/1993 | Wilkerson | 5/655 |
| 5,261,134 | 11/1993 | Matthews . | |
| 5,360,017 | 11/1994 | Austin | 5/922 X |
| 5,647,076 | 7/1997 | Gearhart | 5/632 X |
| 5,790,999 | 8/1998 | Clark | 5/655 |
| 5,860,174 | 8/1998 | Failor | 5/922 X |
| 5,937,465 | 8/1999 | Carew et al. | 5/655 X |
| 5,963,998 | 10/1999 | Carew et al. | 5/655 |

FOREIGN PATENT DOCUMENTS

| | | | |
|---|---|---|---|
| 2016918 | 9/1979 | United Kingdom | 5/655.9 |

OTHER PUBLICATIONS

"Self–Adhering Nylon Tapes", *Journal of AMA,* vol. 168, No. 7. Maurice Gershman, M.D., Oct. 18, 1953.

*Primary Examiner*—Terry Lee Melius
*Assistant Examiner*—Robert G. Santos
*Attorney, Agent, or Firm*—Kevin L. Klog

[57] ABSTRACT

A multilayer infant support and reclining pillow device for laying, propping, sitting and supporting infants and toddlers having a top layer, bottom layer and an insert which are able to be attached and secured to each other. The multilayer infant support and reclining pillow device allows for the placement of an infant or toddler within an inside portion in order to help the infant to develop his or her sitting posture. The multilayer infant support and reclining pillow device also assembles in such a form as to provide an angled base onto which an infant may be laid face up and thereby be assured of a safe breathing posture.

10 Claims, 14 Drawing Sheets

MULTILAYER INFANT SUPPORT AND RECLINING PILLOW DEVICE

This application claims priority of Provisional Patent Application Ser. No. 60/057,451, filed Sep. 3, 1997.

BACKGROUND OF THE INVENTION

The present invention relates in general to infant support pillow devices for laying, propping and supporting infants and toddlers and more particularly, to an infant support pillow which has multiple layers which allow the support pillow to be adjusted in height and contour. The infant support pillow of this invention is an improvement over conventional infant support pillow devices.

With conventional infant support pillows, support for an infant or toddler is generally provided with a single layer of fabric covered flexible foam material which is shaped to partially surround the torso of an infant or toddler. The prior art methods of support generally do not surround the whole of the infant, nor do they provide the necessary adjustment to allow the positioning of an infant in a seated position. An example of the prior art conventional infant support pillow is described in U.S. Pat. No. 5,261,134, Infant Support Pillow, issued to Matthews on Nov. 16, 1993. It describes a single layer infant support pillow with opposed cantilever arms which are in confronting relation to one another. There is no enclosed base for safety nor are any means provided for seating an infant or toddler. The prior art generally provides for propping only. The limitation of such devices make them of marginal use to the parent of a toddler or infant.

Accordingly, it is an object of the present invention to provide an improved infant support pillow with adjustable height that is inherently stable, easy to adjust, and able to provide a wide range of positioning to an infant or toddler.

Another object of the present invention is to provide an improved infant support pillow with multiple sections which are able to be used in conjunction with one another or separately in order to provide a desired posture for an infant or toddler.

A further object of the present invention is to provide an improved infant support pillow which allows a parent to provide a desired posture for an infant or toddler even as the infant or toddler grows.

A still further object of the present invention is to provide an improved infant support pillow which helps to support an infant during the transition to the toddler stage as the child learns to sit and which provides one or more toys for the infants amusement.

SUMMARY OF THE INVENTION

To accomplish the foregoing and other objects of this invention there is provided an a multilayer infant support and reclining pillow device for laying, propping, sitting and supporting infants and toddlers. It is composed of a bottom layer, a top layer and an insert which is used to help in propping and supporting the infant. The insert is used in conjunction with the top layer only as a support for the infant when he/she is laying face up. The top layer and the bottom layer are separable and able to be used apart or together. The insert is generally used only when the top layer is separated from the bottom layer, but is also usable as an infant foot support in the bottom layer to help promote a sitting posture. Each layer attaches to another or the insert via hook and loop fasteners.

The bottom layer or base is comprised of a fabric covered flexible foam material which is formed into a substantially polygonal shape which is enclosed on all sides with an opening in its center. The bottom layer enclosure acts as a safety barrier for the infant or toddler. It is used in conjunction with the top layer to form a space for an infant or toddler to be supported in the seating position. It is also capable of being used alone as an enclosure within which a toddler may play.

The top layer is similar in outside shape to the bottom layer but has an open end towards the front of the device whereby the infant may crawl into or out of it. It is also manufactured of a fabric covered flexible foam material. The top layer and insert also have a slight taper toward the frontmost portion. The top layer may also be used alone with or without the insert to provide a device for propping or laying an infant or toddler. When used in conjunction with the insert, especially for very young infants, sitting may not be practical or desirable. In this case, the insert may be placed and secured within the topmost portion to form a tapered surface upon which the infant may be laid face up. Securing is provided with hook and loop type fasteners.

In a preferred embodiment, the bottom layer has a durable material covering the bottommost center open portion. In a preferred embodiment the material is flexible. Alternative embodiments may incorporate a non-flexible material.

In use, the infant or toddler is placed within the opening formed when the top layer and bottom layer are stacked together. In a preferred embodiment hook and loop type fasteners are used to connect all portions together, but other means may also be used. The rearmost portion of the stacked top layer and bottom layer (safety barrier) act as a support for the infant in the sitting or propped up position. Attached to the bottom and/or top layer is one or more toys which act as an amusement for the infant. The toys include such amusements as loops, hooks, pockets, or small rattle type toys.

This device may be manufactured of many types of various materials including but not limited to plastic, foam, resin, or an air filled bladder which are covered with a flexible material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
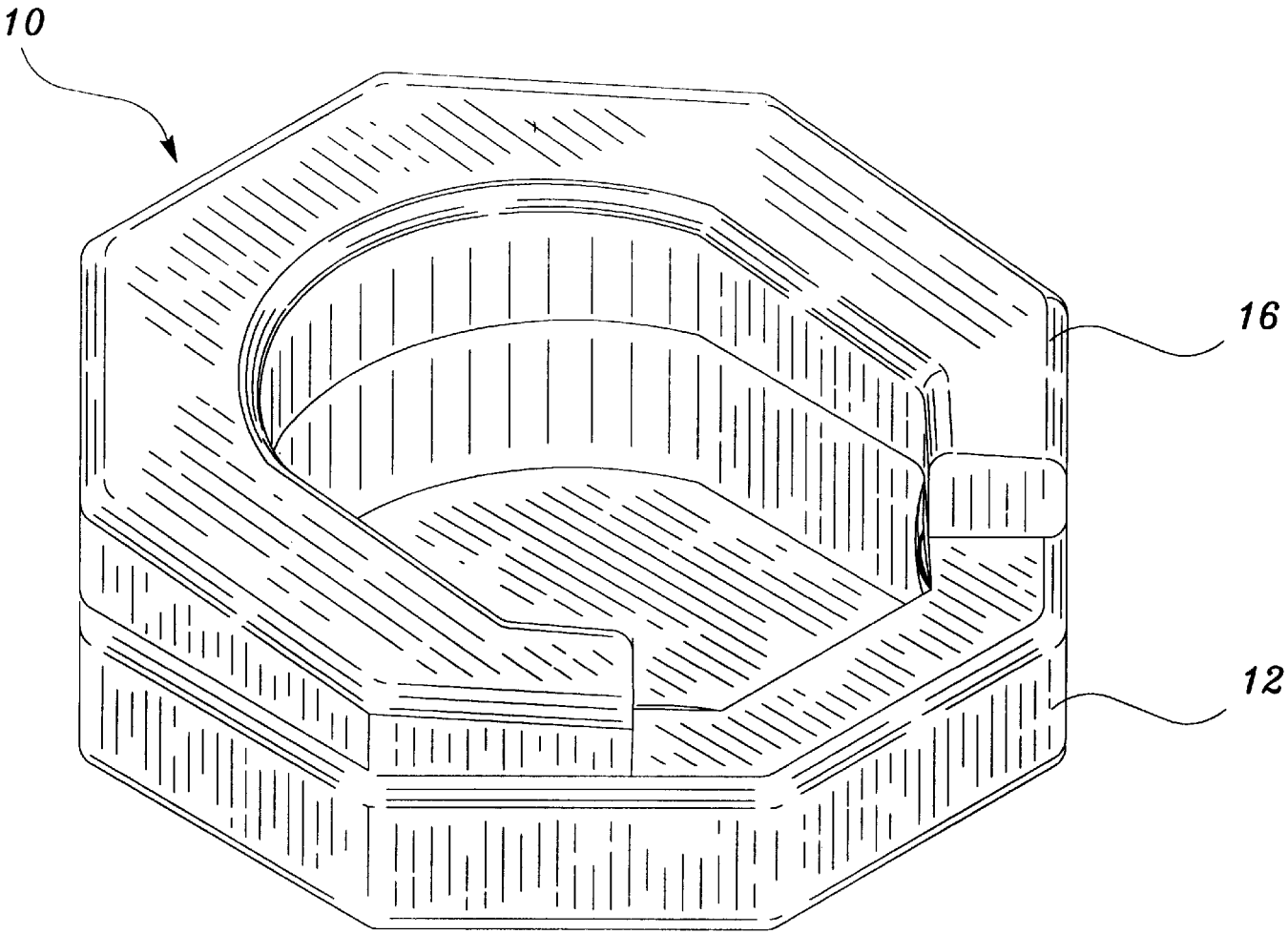
FIG. 1 is a perspective view of a multilayer infant support and reclining pillow device without an insert.
Figure 2:
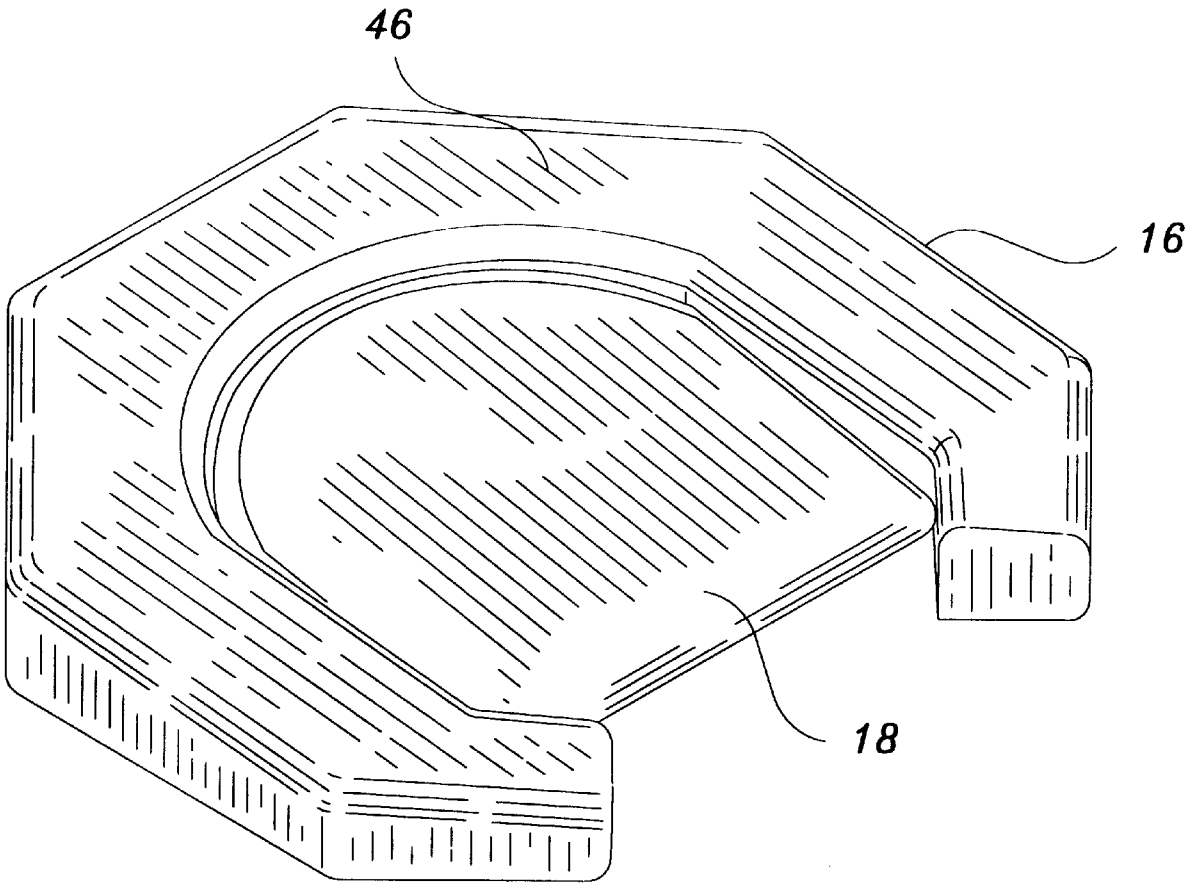
FIG. 2 is a perspective view of a top layer with an insert of a multilayer infant support and reclining pillow device.
Figure 3:
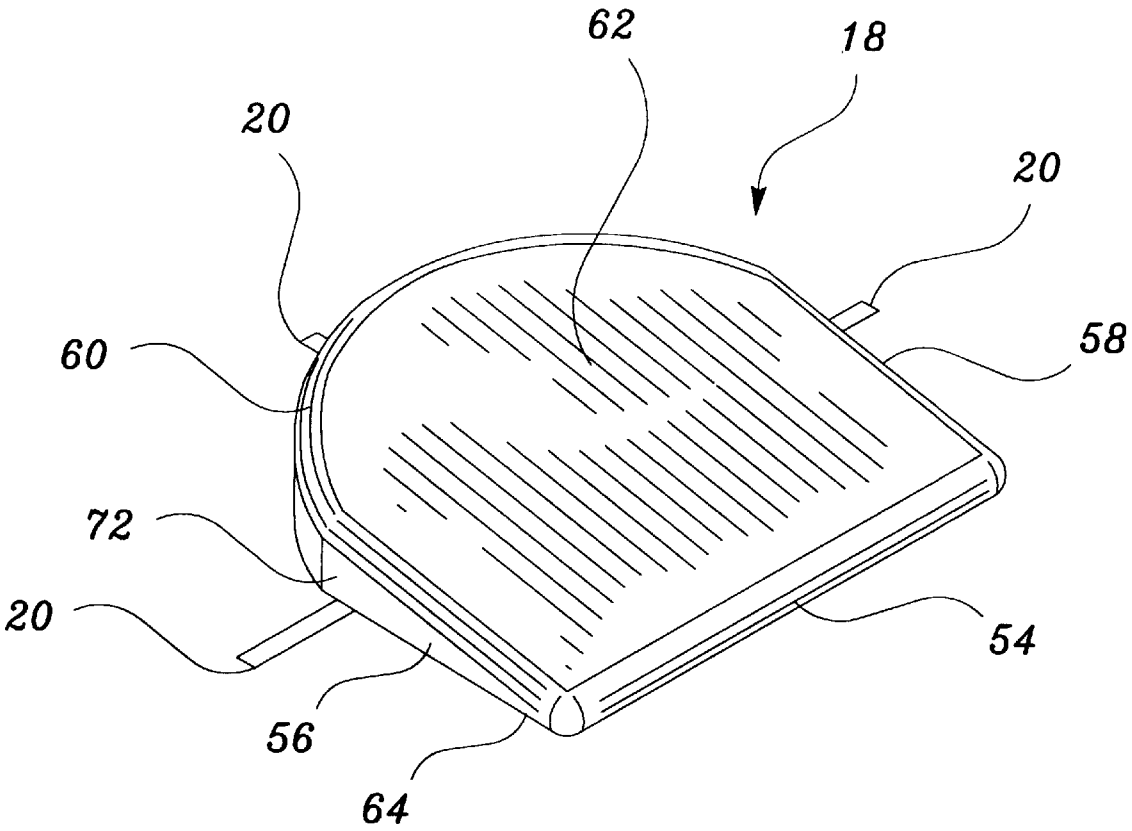
FIG. 3 is a perspective view of the insert of a multilayer infant support and reclining pillow device.
Figure 4:
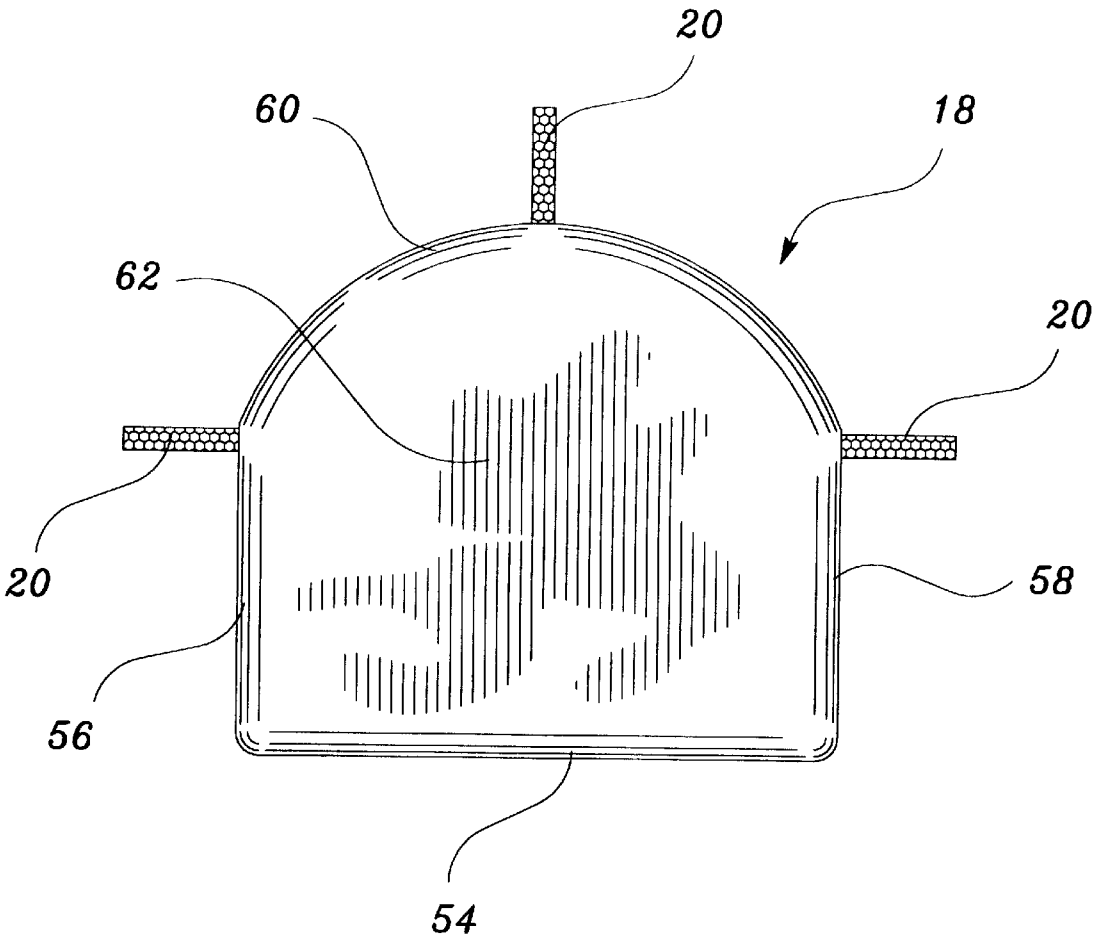
FIG. 4 is a top side plan view of the insert of a multilayer infant support and reclining pillow device.
Figure 5:
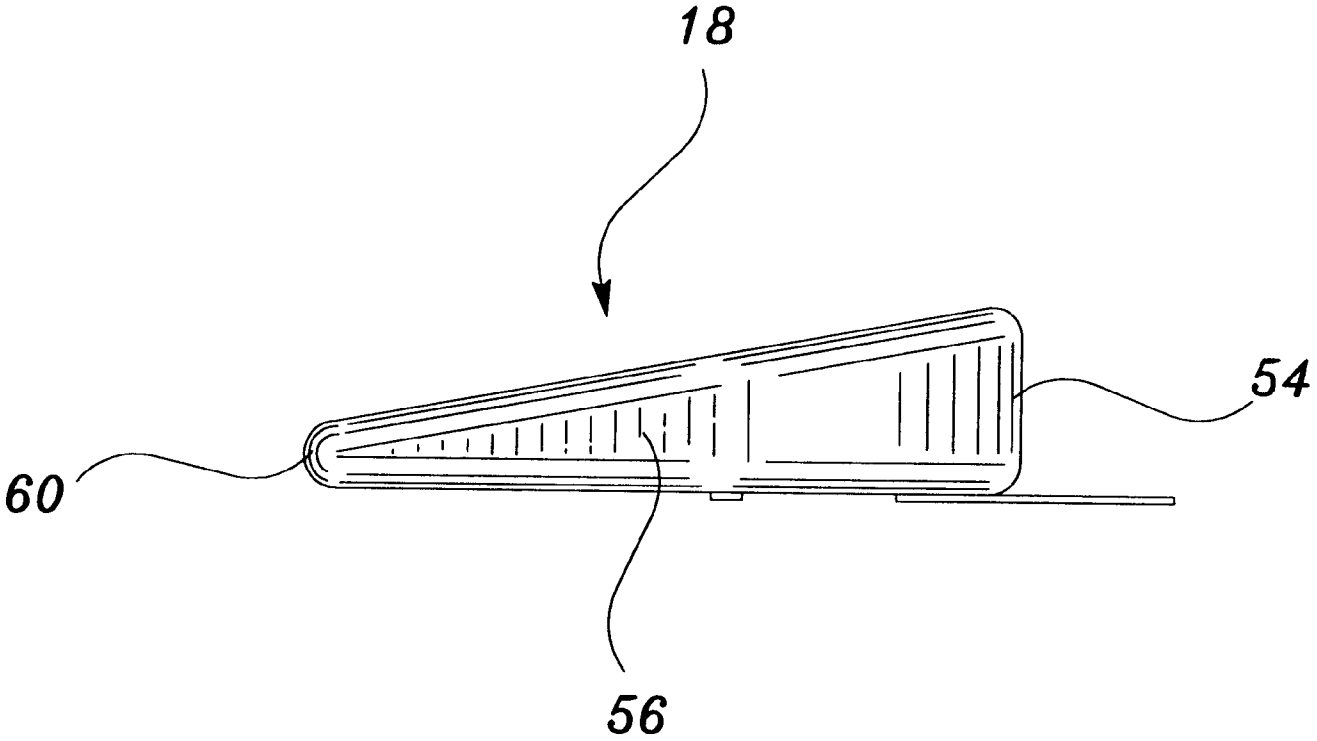
FIG. 5 is a right side plan view of the insert of a multilayer infant support and reclining pillow device which is also symmetrical with a left plan view.
Figure 6:
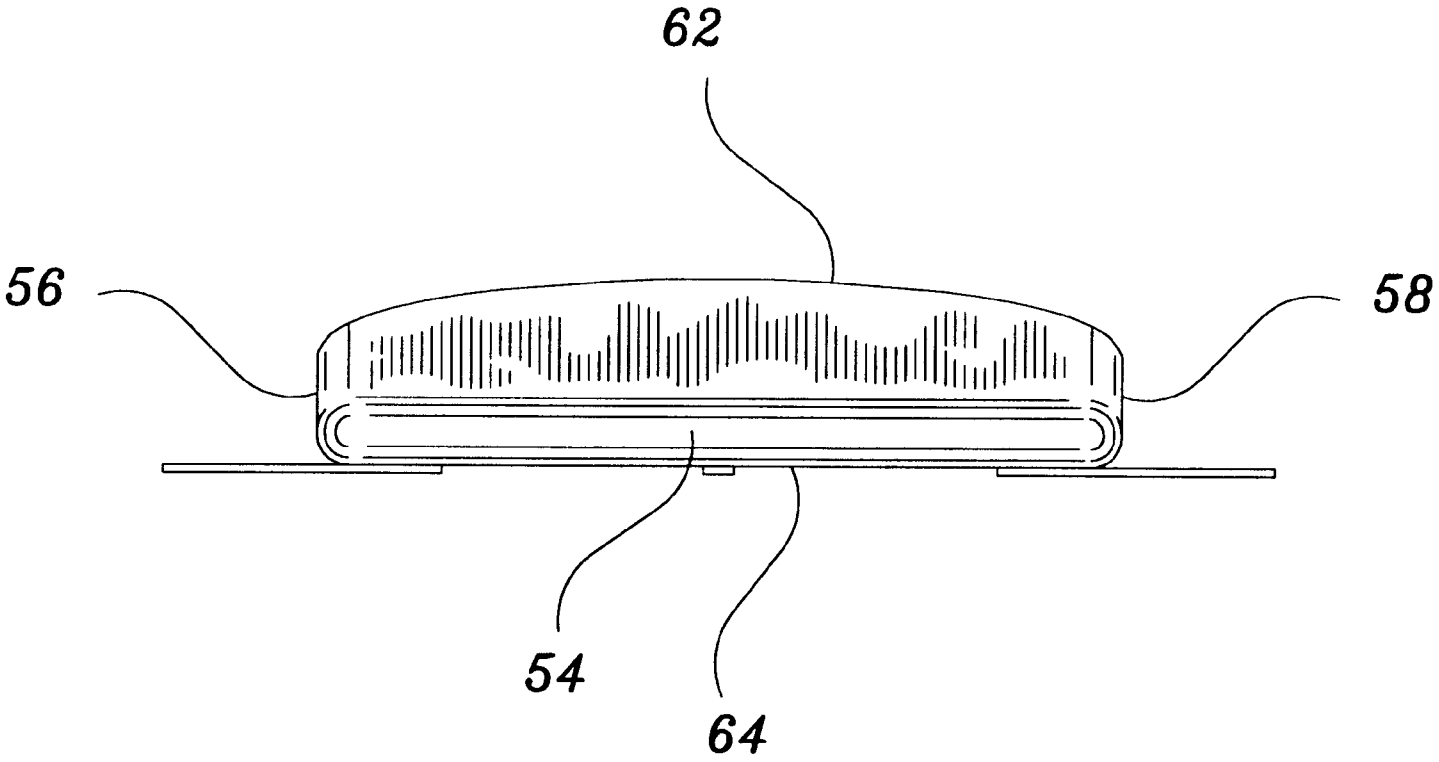
FIG. 6 is a front side plan view of the insert of a multilayer infant support and reclining pillow device.
Figure 7:
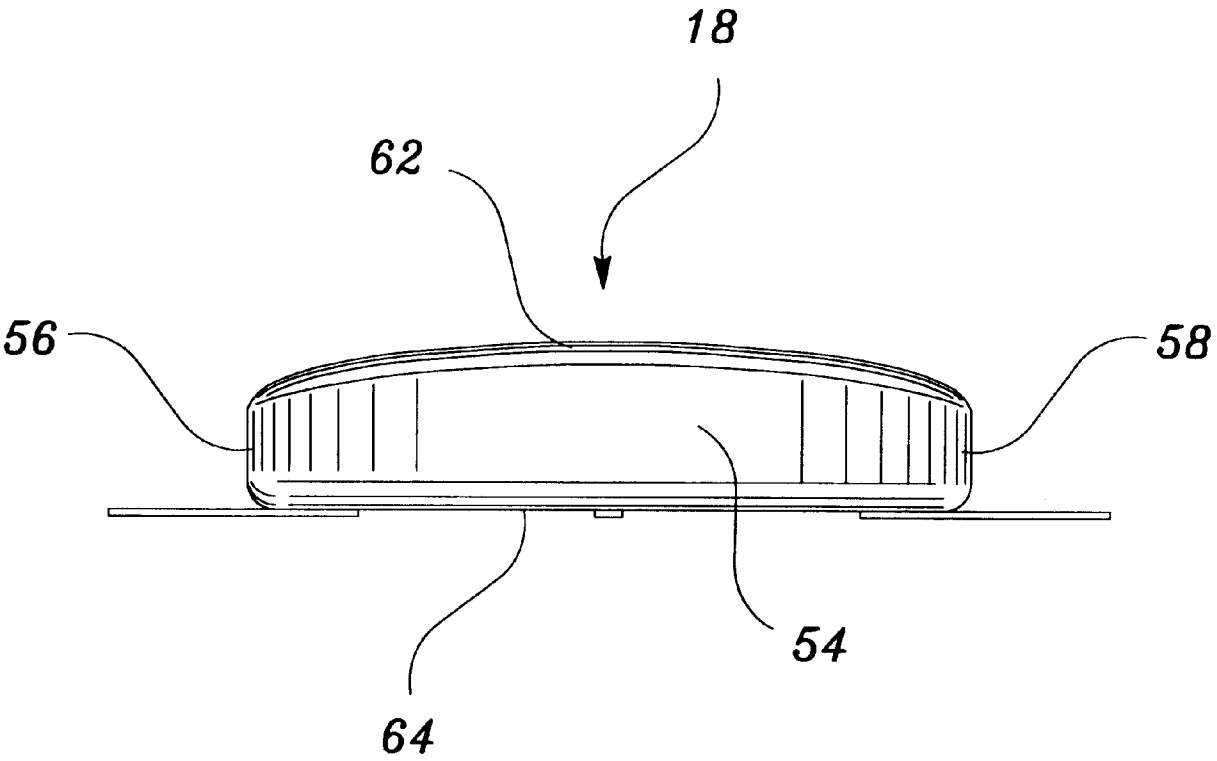
FIG. 7 is a back side plan view of the insert of a multilayer infant support and reclining pillow device.
Figure 8:
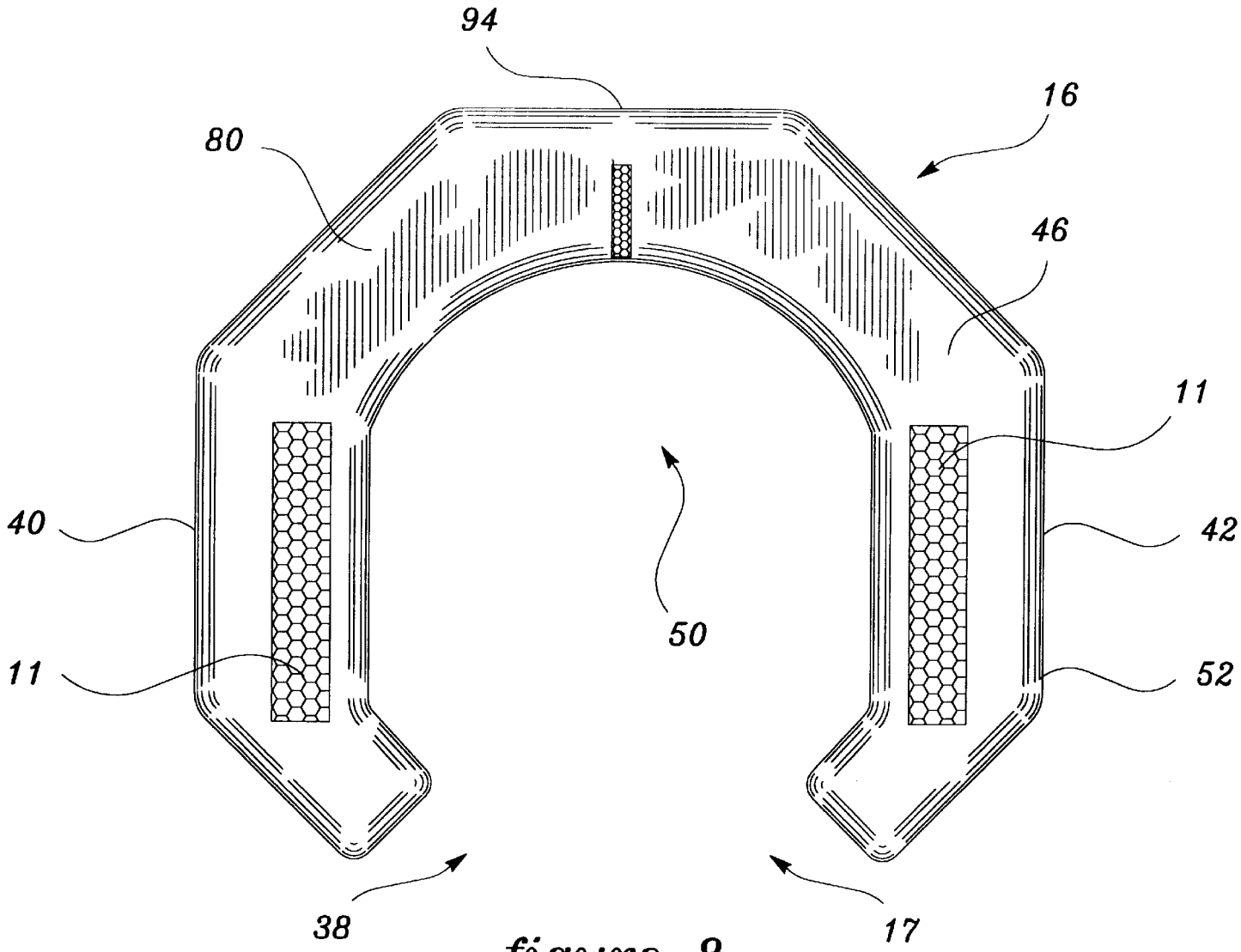
FIG. 8 is a bottom side plan view of the top layer of a multilayer infant support and reclining pillow device.
Figure 9:
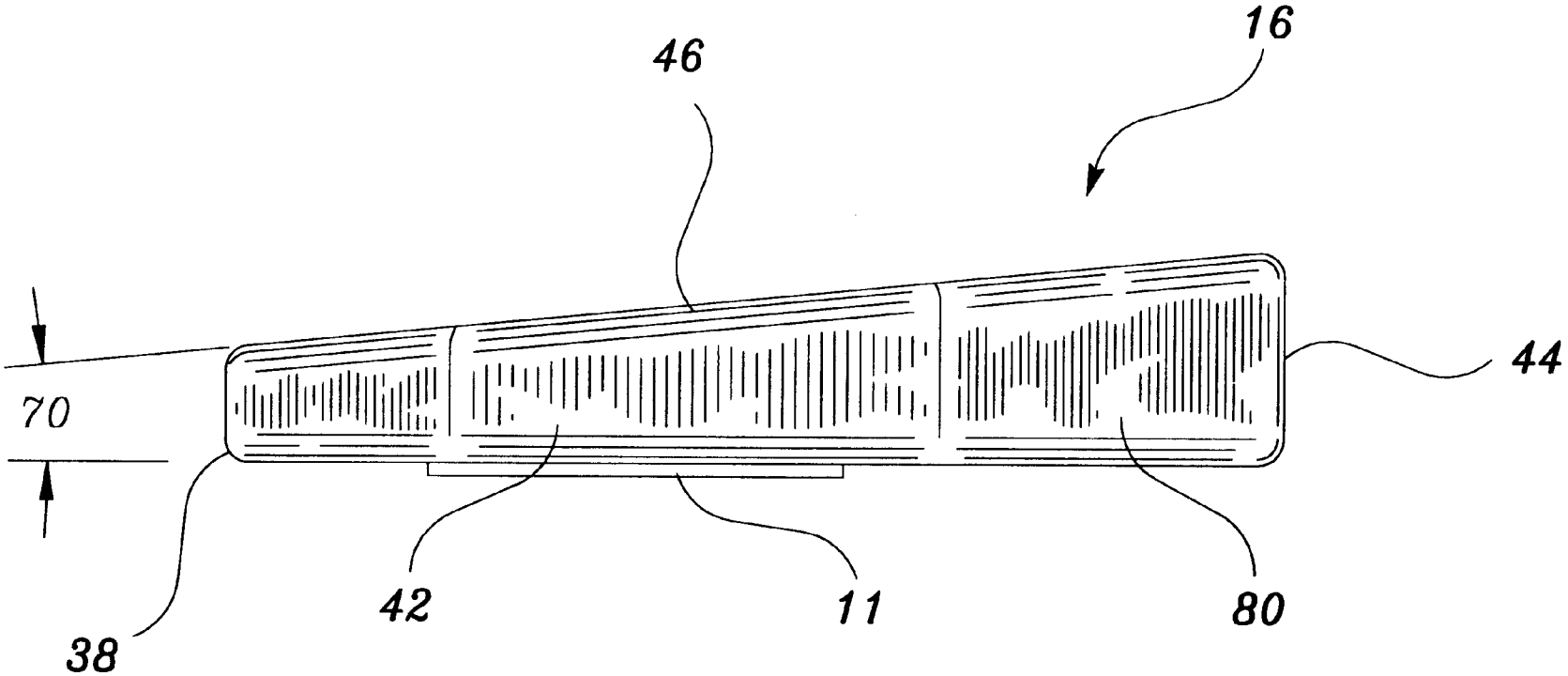
FIG. 9 is a right side plan view of the top layer of a multilayer infant support and reclining pillow device.
Figure 10:
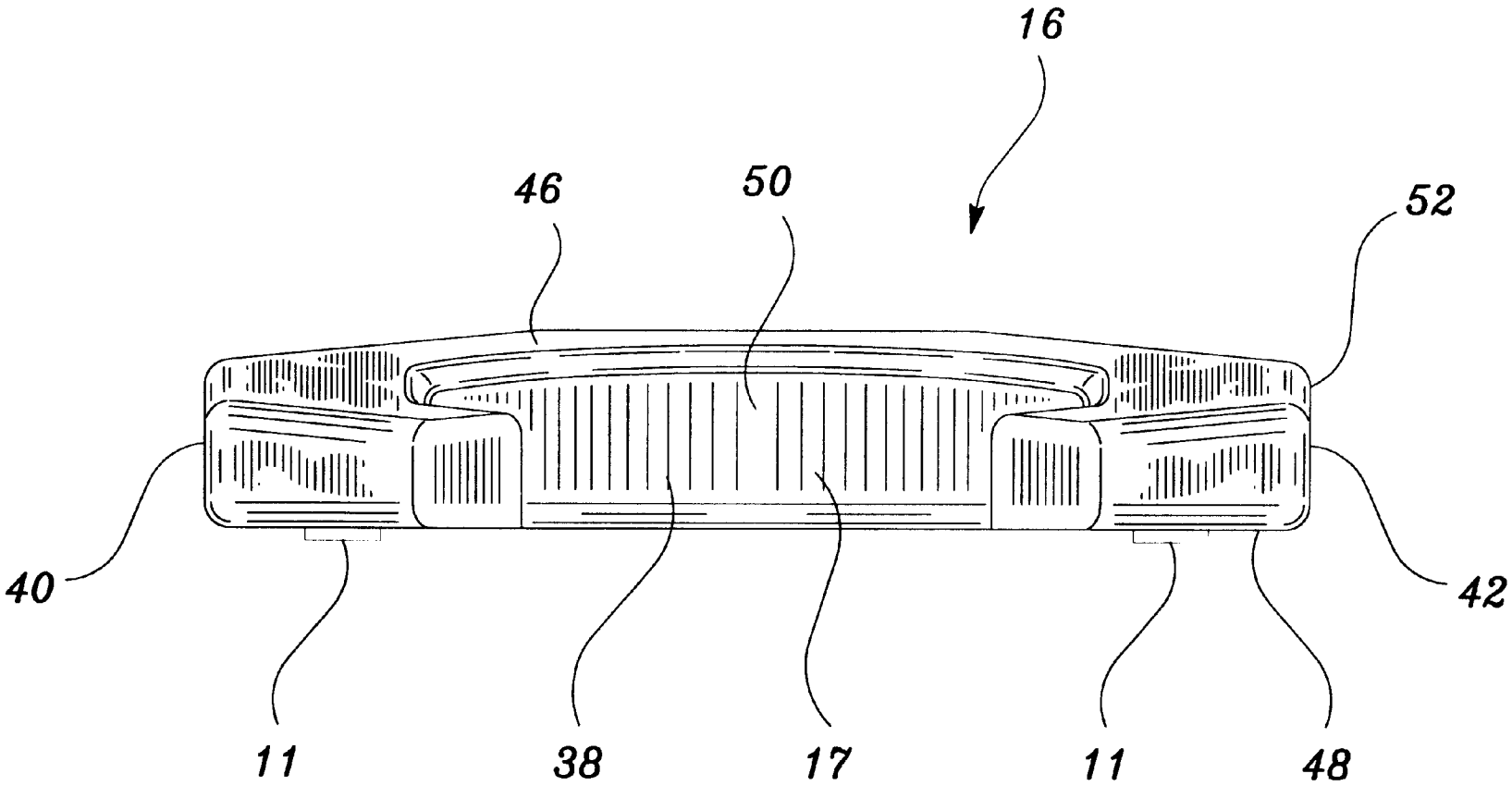
FIG. 10 is a front side plan view of the top layer of a multilayer infant support and reclining pillow device.
Figure 11:
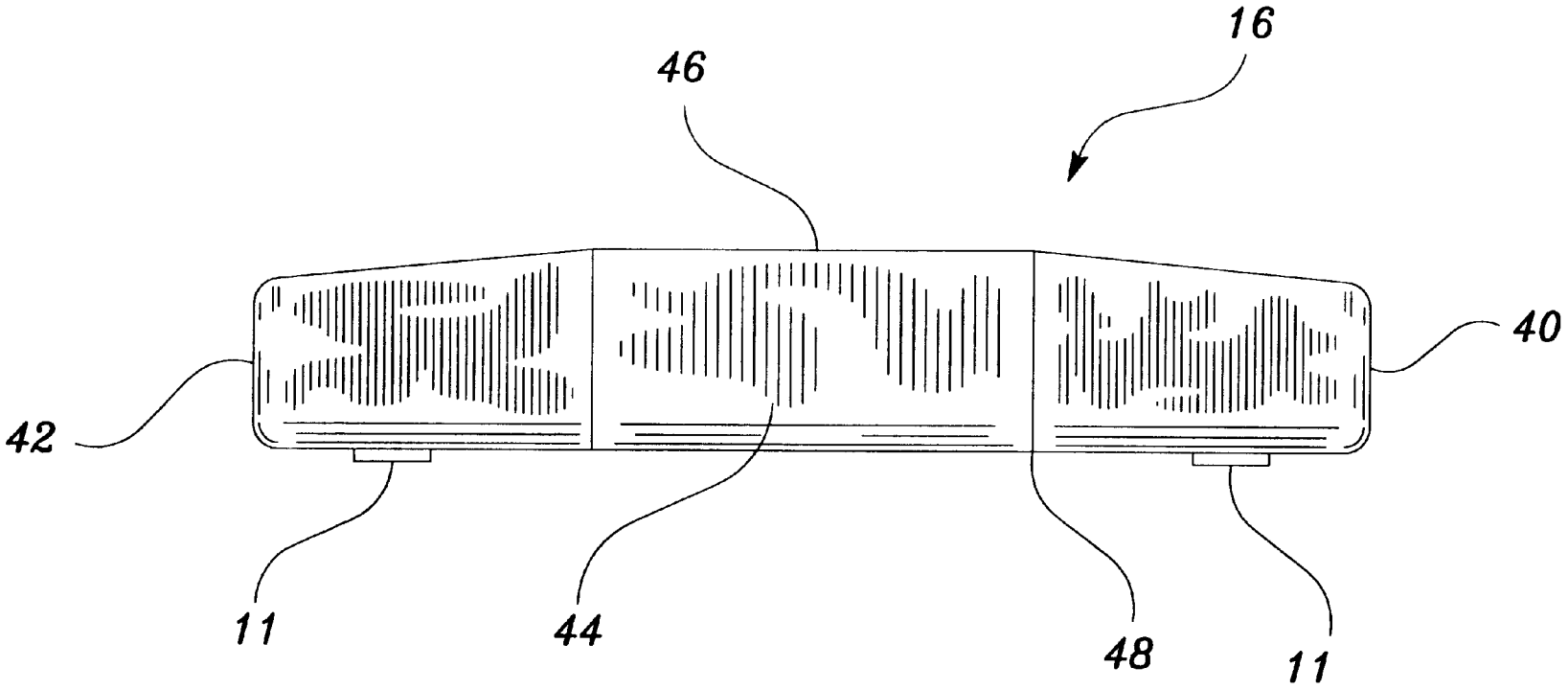
FIG. 11 is a back side plan view of the top layer of a multilayer infant support and reclining pillow device.
Figure 12:
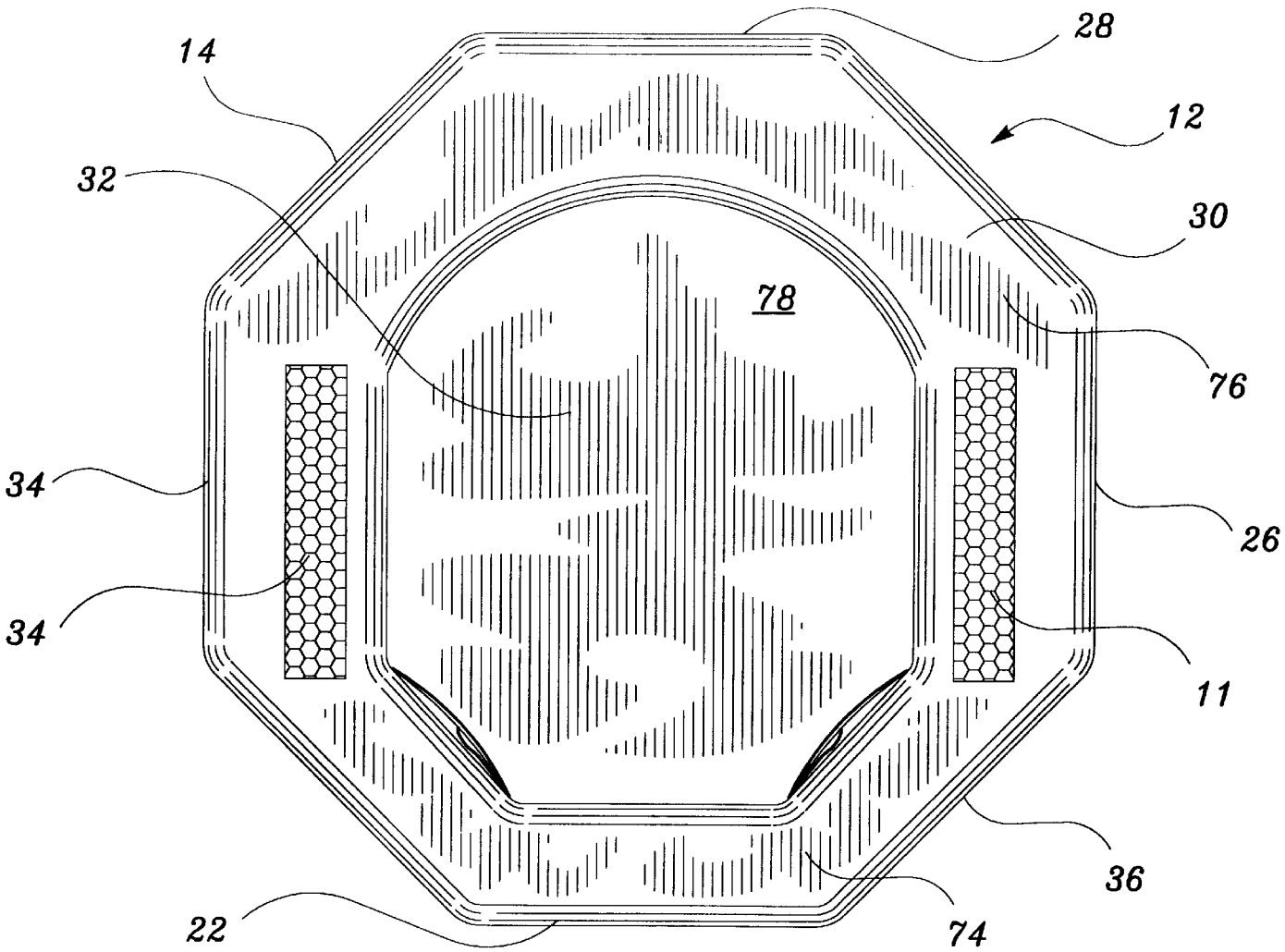
FIG. 12 is a top side plan view of the bottom layer of a multilayer infant support and reclining pillow device.
Figure 13:
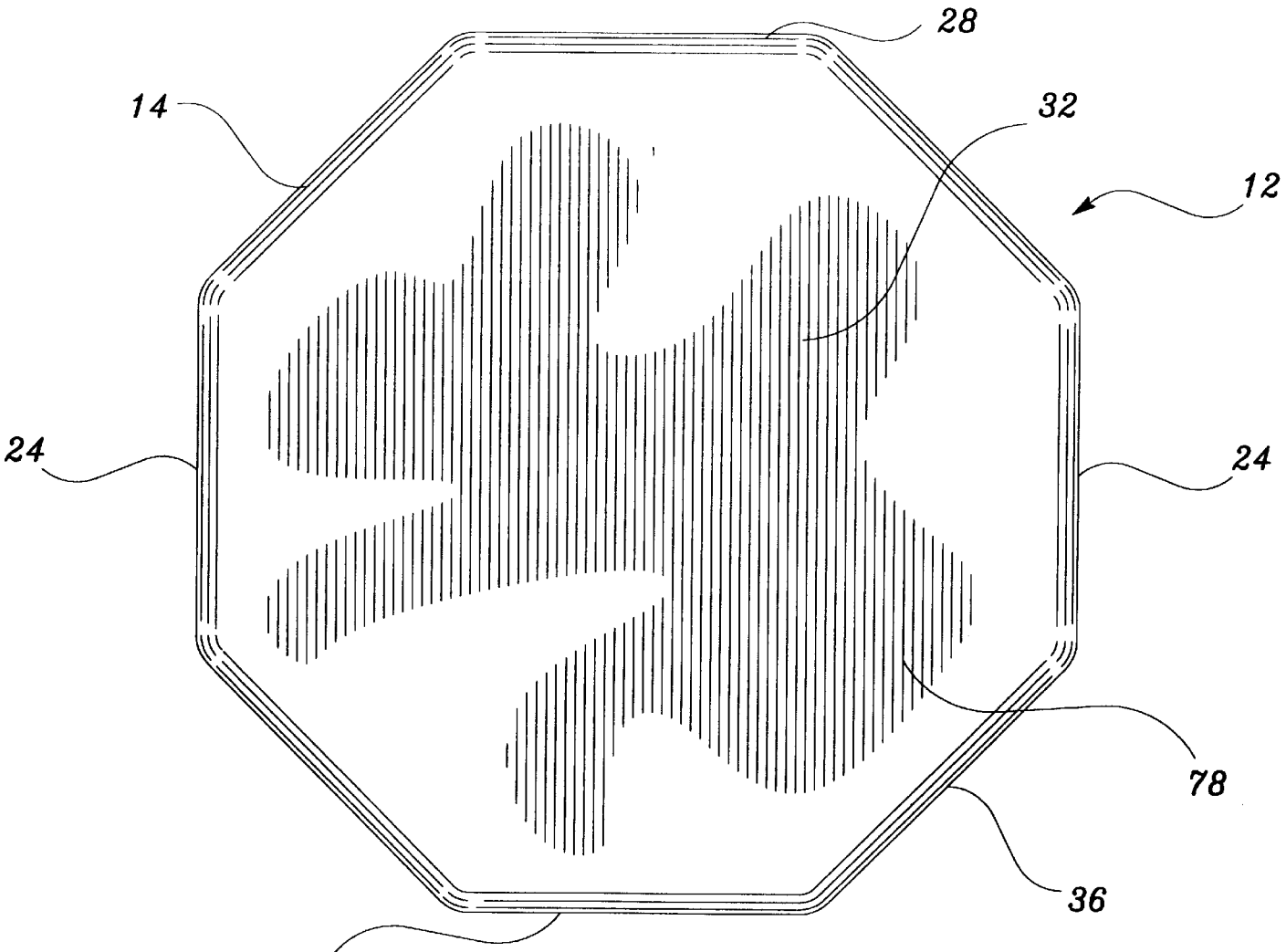
FIG. 13 is a bottom side plan view of the bottom layer of a multilayer infant support and reclining pillow device.
Figure 14:
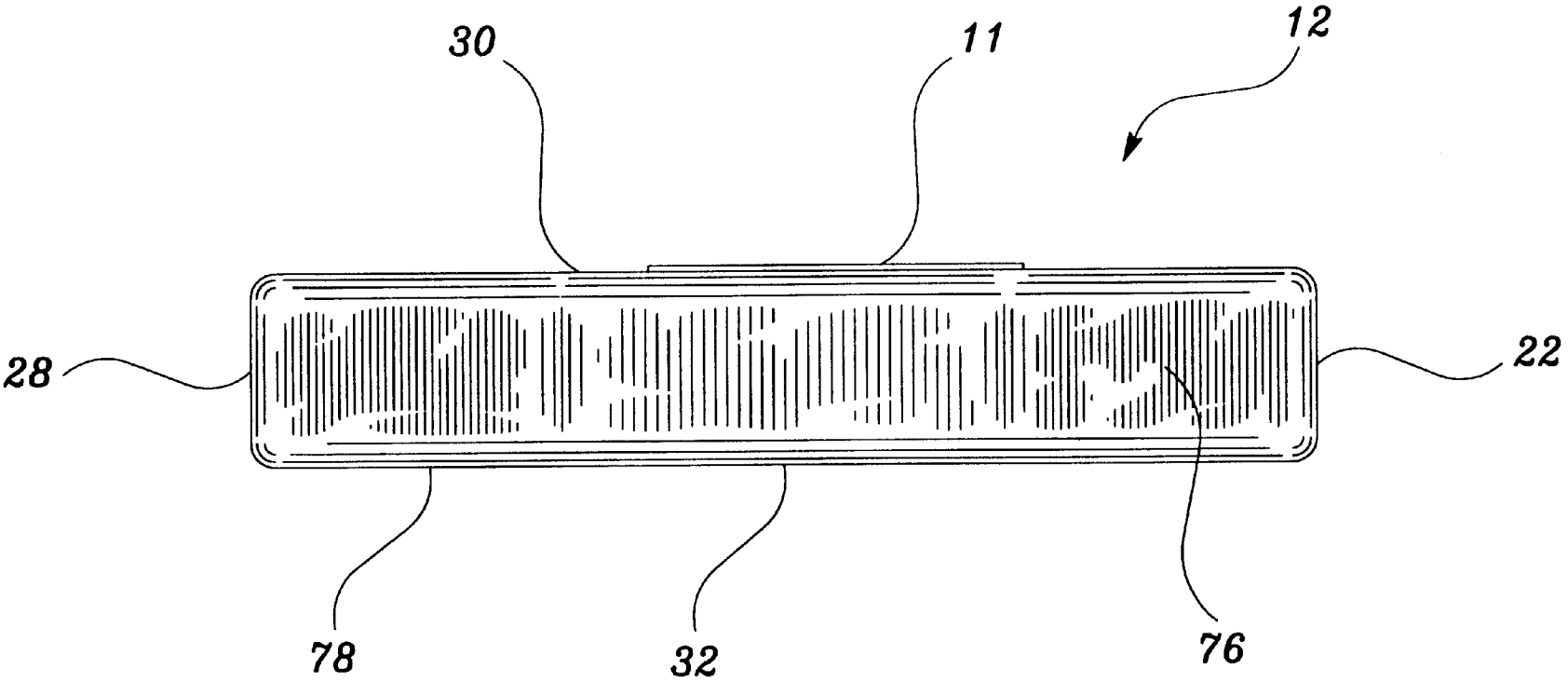
FIG. 14 is a bottom side plan view of the bottom layer of a multilayer infant support and reclining pillow device.

Referring now to the drawings, there is shown in FIGS. 1–14 a preferred embodiment of the multilayer infant support and reclining pillow device 10 of this invention. The multilayer infant support and reclining pillow device of the present invention is particularly adapted for use by parents of infants or toddlers to help position infants or toddlers in a safe and proper laying, propping, or sitting posture. It may also be used by toddlers as they grow from the infant stage.

The drawings show the multilayer infant support and reclining pillow device 10 comprising a bottom layer 12 of substantially polygonal shape 14, a top layer 16, and an insert 18. In a preferred embodiment, the insert 18 is generally used in conjunction with the top layer 16 only, but may also be used inside the bottom layer 12 for propping an infants feet to promote a sitting posture. That is, the wedging action of the insert 18 helps to prevent the infant from falling forward. In a preferred embodiment, the layers 12, 16 are attached and secured to each other with the use of hook and loop fastener strips 11. The insert 18 is attached and secured to the top layer 16 with the aid of extended hook and loop strips 20. In a preferred embodiment, one or more rattle and/or squeeze type toys 70 are affixed to the bottom layer 12 in order to provide a means of amusement for an infant or toddler.

The bottom layer 12 is comprised of a spongy flexible material, typically foam, covered with a flexible covering material, typically fabric. The bottom layer 12 is shaped such that it is defined with a front 22, back 28, right 24, left 26, top 30, and bottom 32 side. The polygonal shape 14 of the bottom layer 12 is such that inside 34 and an outside 36 portions may be defined. In a preferred embodiment as shown in the drawings, the polygonal shape 14 is defined as a octagon, but may be manufactured in a variety of polygonal shapes from elliptical to rectangular to any multi-sided form which may be desired. The polygonal shape 14 is formed via a bottom layer substantially vertical wall 76 which forms the barrier between the inside 34 and outside 36 portions. The polygonal shape 14 formed by said vertical wall 76 acts as a safety barrier 74 for an infant or toddler which is placed within the bottom layer 12. In a preferred embodiment a durable material 78 with a flexible nature is placed and secured onto the bottom 32 in order to cover the lower portion of the bottom layer inside 34. Alternative embodiments may incorporate a non-flexible material affixed to the bottom 32. As an amusement for an infant or toddler, one or more toys 70 are typically placed near the front 22 of the bottom layer 12 in a preferred embodiment. In a preferred embodiment, the bottom layer top 30 contains one or more hook and loop fastener strips 11 on its top 30 portion which allow for the attachment and securing of the top layer 16 onto the top 30 of said bottom layer 12.

The top layer 16 has substantially the same polygonal form as the bottom layer 12, and thereby also having a top layer front 38, back 44, right 40, left 42, top 46, and bottom 48. The top layer 16 differs from the bottom layer 12 in that it has an open end 17 near the top layer front 38 and contains a top layer taper 71 from the top layer back 44 to the top layer front 38. In a preferred embodiment, the narrowest part of the taper 71 is found at the top layer front 38. The polygonal shape of the top layer 16 is formed via a top layer substantially vertical wall 80 which forms the barrier between the top layer inside 50 and outside 52 portions. In a preferred embodiment, onto the bottom 48 of the top layer 16 is attached one or more hook and loop fastener strips 11 which allow the top layer 16 to be attached and secured to the bottom layer 12. In a preferred embodiment, the top layer 16 is formed of the same material and covering as the bottom layer 12.

Alternate embodiments may replace the hook and loop faster strips 11 and the extended hook and loop strips 20 with buttons, hooks, pockets, magnets, simple frictional contact or other means for attaching the layers together. Alternate embodiments may be comprised of a form of attachment which is simply a contacting and touching of the top layer 16 bottom side 48 onto the bottom layer 12 top side 30.

In a preferred embodiment, the insert 18 is of such a form that it is able to substantially fill the area in the top layer 16 defined by the inside 50 of the top layer 16. It comprises an insert layer front 54, back 60, right 56, left 58, top 62 and bottom 64. In a preferred embodiment, it further contains one or more extended hook and loop fastener strips 20 which extend outward from the back 60, right 56, and left 58 of the insert 18 and are able to mate and connect with the one or more hook and loop fastener strips 11 which are located on the bottom 48 of the top layer 16. In order to substantially conform to the top layer taper 71, the insert 18 contains an insert taper 72 from the insert layer back 60 to the insert layer front 54. In a preferred embodiment, the narrowest part of the insert taper 72 is found at the insert layer front 54. In a preferred embodiment, the insert layer 18 is formed of the same material and covering as the bottom layer 12.

In operation, the parent or caretaker of an infant or toddler places the top layer 16 onto the bottom layer 12 and secures the layers 12, 16 with the hook and loop fastener strips 11. The infant or toddler is then placed into the inside portions 34,50 and allowed to develop a sitting or propping posture by leaning against the vertical walls 76, 80. If propping of the infants feet is desired for proper seating posture, the insert 18 is placed under the infant's feet. This helps to prevent the infant from falling forward. Self amusement is provided for the infant or toddler with the provision of one or more toys 70 which are attached to the top or bottom layers. Should the parent or caretaker wish to support an infant or toddler in a laying position with the necessary angle to allow clear breathing, the top layer 16 is removed from the assembly and the insert 18 is placed within the top layer inside portion 50. The assembly is then placed onto a flat surface and the infant or toddler is set face up onto the top portions 46, 62. A multitude of other playtime forms may be had by mixing, matching and attaching the bottom layer 12, top layer 16 and insert 18 into combinations which the parent or toddler may find amusing.

From the foregoing description, those skilled in the art will appreciate that all objects of the present invention are realized. A multilayer infant support and reclining pillow device for laying, propping, sitting and supporting infants and toddlers has been shown and described. The device of this invention is able to withstand the weight of infants and toddlers and provide an enjoyable playtime experience for such.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A multilayer infant support and reclining pillow device comprising:

a bottom layer of substantially octagonal continuous shape, defined by a bottom layer substantially vertical wall, said vertical wall of sufficient width and height to act as a safety barrier for an infant or toddler;

said bottom layer having a bottom layer front side, a bottom layer back side, a bottom layer right side, a bottom layer left side, a bottom layer top side and a bottom layer bottom side; and said bottom layer further having a bottom layer inside and a bottom layer outside separated and defined by said bottom layer substantially vertical wall; and a durable material placed and secured onto said bottom layer and further covering said bottom layer bottom side including said bottom layer inside of said bottom side; and a top layer of substantially similar octagonal shape as said bottom layer and defined by a top layer substantially vertical wall of similar width to said bottom layer substantially vertical wall and having an open end;

said top layer having a top layer front side, a top layer back side, a top layer right side, a top layer left side, a top layer top side and a top layer bottom side; and said top layer further having a top layer inside and a top layer outside separated and defined by said top layer substantially vertical wall; and said top layer open end located at said top layer front side and said top layer inside aligned with said bottom layer inside; and said top layer substantially vertical wall having a taper from said top layer back side to said top layer front side wherein said top layer front side contains the narrowest part of the taper; and attachment means whereby said top layer bottom side is removably attached to said bottom layer top side whereby said top layer front side is substantially aligned with said bottom layer front side, said top layer right side is substantially aligned with said bottom layer right side, said top layer left side is substantially aligned with said bottom layer left side, and said top layer back side is substantially aligned with said bottom layer back side.

2. The multilayer infant support and reclining pillow device as set forth in claim 1 whereby:

said bottom layer substantially vertical wall and said top layer substantially vertical wall are formed from a spongy flexible material having a flexible covering.

3. The multilayer infant support and reclining pillow device as set forth in claim 1 further comprising:

one or more toys attached to said bottom layer proximately near said bottom layer front.

4. The multilayer infant support and reclining pillow device as set forth in claim 1 further comprising:

one or more toys attached to said top layer proximately near said bottom layer front.

5. The multilayer infant support and reclining pillow device as set forth in claim 1 whereby:

said attachment means are comprised of one or more hook and loop type fasteners mounted onto said bottom layer top side and one or more hook and loop type fasteners mounted onto said top layer bottom side.

6. The multilayer infant support and reclining pillow device as set forth in claim 1 further comprising:

an insert layer of substantially similar shape as said bottom layer inside defined by said bottom layer substantially vertical wall; and said insert layer having an insert layer front side, an insert layer back side, an insert layer right side, an insert layer left side, an insert layer top side and an insert layer bottom side; said insert located within said bottom layer inside and said bottom layer front side substantially aligned with said insert layer back side, said bottom layer right side substantially aligned with said insert layer left side, said bottom layer left side substantially aligned with said insert layer right side, and said bottom layer back side substantially aligned with said insert layer front side and;

said insert tapered from said insert layer back side to said insert layer front side.

7. A multilayer infant support and reclining pillow device comprising:

a top layer of substantially polygonal shape defined by a top layer substantially vertical wall having an open end;

said top layer having a top layer front side, a top layer back side, a top layer right side, a top layer left side, a top layer top side and a top layer bottom side; and said top layer further having a top layer inside and a top layer outside separated and defined by said top layer substantially vertical wall; and said top layer open end located substantially at said top layer front side; and an insert layer of substantially similar shape as said top layer inside defined by said top layer substantially vertical wall; and said insert layer having an insert layer front side, an insert layer back side, an insert layer right side, an insert layer left side, an insert layer top side and an insert layer bottom side; and attachment means whereby said insert layer is removably attached to said top layer inside whereby said top layer front side is substantially aligned with said insert layer front side, said top layer right side is substantially aligned with said insert layer right side, said top layer left side is substantially aligned with said insert layer left side, and said top layer back side is substantially aligned with said insert layer back side; and said top layer substantially vertical wall and said insert layer formed from a spongy flexible material having a flexible covering; and said top layer further having a top layer taper from said top layer back to said top layer front; and said insert layer having an insert layer taper from said insert layer back to said insert layer front, whereby said distance from said top layer bottom to said top layer top is less at said top layer front than at said top layer back and said distance from said insert layer bottom to said insert layer top is less at said insert layer front than at said insert layer back.

8. The multilayer infant support and reclining pillow device as set forth in claim 7 whereby:

said attachment means are comprised of one or more hook and loop type fasteners mounted onto said top layer bottom side and one or more extended hook and loop type fasteners mounted onto said insert layer bottom side; and said one or more extended hook and loop type fasteners extended outward from said insert layer.

9. The multilayer infant support and reclining pillow device as set forth in claim 7 whereby:

said substantially polygonal shape of said top layer outside is octagonal.

10. A method for supporting an infant or toddler in a sitting position comprising:

forming a bottom layer of substantially octagonal continuous shape, defined by a bottom layer substantially vertical wall, from a fabric covered foam material, said vertical wall of sufficient width and height to act as a safety barrier for an infant or toddler, whereby said bottom layer has a bottom layer front side, a bottom layer back side, a bottom layer right side, a bottom layer left side, a bottom layer top side and a bottom layer bottom side; and a bottom layer inside and a bottom layer outside separated and defined by said bottom layer substantially vertical wall; and placing a durable material over said bottom layer bottom side including said bottom layer inside of said bottom layer bottom side; and forming a top layer of substantially similar octagonal shape as said bottom layer and defined by a top layer substantially vertical wall of similar width to said bottom layer substantially vertical wall and having an a top layer front side, a top layer back side, a top layer right side, a top layer left side, a top layer top side and a top layer bottom side, and a top layer inside and a top layer outside separated and defined by said top layer substantially vertical wall, and further forming a taper along said top layer substantially vertical wall wherein said top layer front side contains the narrowest part of the taper; and removing said top layer front side in order to form an open end at said top layer front side; and placing, aligning, and securing said top layer bottom side onto said bottom layer top side whereby said open end is aligned with said bottom layer front side; and placing a tapered thickness insert layer inside said bottom layer inside, whereby a thickest tapered end is located nearest said bottom layer front side; and placing said infant or toddler into said bottom layer inside whereby a head of said infant or toddler extends above said top layer; and propping one or more feet of said infant or toddler onto said insert layer; and placing a back portion of said infant or toddler in contact with said bottom layer and said top layer nearest said top layer back side and said bottom layer back side, whereby said infant or toddler is supported in a sitting position.

* * * * *